US007243384B2

(12) United States Patent
Le Gette et al.

(10) Patent No.: US 7,243,384 B2
(45) **Date of Patent: *Jul. 17, 2007**

(54) COLLAPSIBLE MAT WITH REMOVABLE PORTION AND METHOD OF MAKING SAME

(75) Inventors: Brian E. Le Gette, Baltimore, MD (US); Justin S. Werner, Millersville, MD (US); Alan Tipp, Baltimore, MD (US); Ronald L. Wilson, II, Catonsville, MD (US); Matthew Laine, Severna Park, MD (US)

(73) Assignee: Kelsyus, LLC, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/356,013

(22) Filed: Feb. 17, 2006

(65) Prior Publication Data

US 2006/0130232 A1 Jun. 22, 2006

Related U.S. Application Data

(60) Continuation of application No. 10/778,341, filed on Feb. 17, 2004, now Pat. No. 7,000,270, which is a continuation of application No. 10/358,303, filed on Feb. 5, 2003, now Pat. No. 6,691,344, which is a division of application No. 09/907,442, filed on Jul. 18, 2001, now Pat. No. 6,519,793.

(51) Int. Cl.
*A47G 9/06* (2006.01)

(52) U.S. Cl. ..... 5/417; 5/419; 5/420; 5/656

(58) Field of Classification Search ..... 5/417–420, 5/656; 160/370.21; 296/97.7

See application file for complete search history.

(56) References Cited

U.S. PATENT DOCUMENTS

| | | | |
|---|---|---|---|
| 722,801 | A | 3/1903 | Bourne, Jr. |
| 1,479,903 | A | 1/1924 | Erland |
| 2,119,023 | A | 5/1938 | Pickard |
| 2,190,566 | A | 3/1940 | Julian |
| 2,344,010 | A | 3/1944 | Walsh |
| 2,357,789 | A | 9/1944 | Levy |
| 2,420,344 | A | 5/1947 | Alexander |
| 2,442,105 | A | 5/1948 | Vacheron |

(Continued)

FOREIGN PATENT DOCUMENTS

| | | |
|---|---|---|
| EP | 0 974 293 | 1/2000 |

*Primary Examiner*—Michael Trettel
(74) *Attorney, Agent, or Firm*—Cooley Godward Kronish LLP

(57) ABSTRACT

A collapsible apparatus is provided that includes a frame configured to form a closed loop, the frame being moveable between a coiled configuration and an uncoiled configuration. A sleeve is configured to receive the frame and to define an opening within at least a portion of the closed loop. An attachment mechanism is coupled substantially about the periphery of the sleeve. A fabric member is removably coupled to the sleeve such that it is easily removed. A method of making mats according to an embodiment of the invention includes cutting fabric members from a first sheet of material, cutting body membranes from a second sheet of material such that the amount of excess material from the second sheet of material between adjacent body membranes is minimized, and attaching one of the body membranes to one of the fabric members.

13 Claims, 16 Drawing Sheets

U.S. PATENT DOCUMENTS 2,637,861 A 5/1953 Kethledge
2,731,997 A 1/1956 Muth et al.
2,803,291 A 8/1957 Meyer
2,870,464 A 1/1959 Lalick
3,052,895 A 9/1962 Lo Vico
3,336,610 A 8/1967 Geddings
3,842,454 A 10/1974 Young
3,862,876 A 1/1975 Graves
3,960,161 A 6/1976 Norman
3,990,463 A 11/1976 Norman
4,097,944 A 7/1978 Yulish
4,200,942 A 5/1980 Case
4,231,125 A 11/1980 Tittl
D261,464 S 10/1981 Smith
4,296,788 A 10/1981 Slater
4,512,049 A 4/1985 Henry
4,561,480 A 12/1985 Underwood et al.
4,709,430 A 12/1987 Nicoll
4,815,784 A 3/1989 Zheng
4,825,892 A 5/1989 Norman
4,856,912 A 8/1989 Damus et al.
4,858,634 A 8/1989 McLeese
4,951,333 A 8/1990 Kaiser et al.
5,024,262 A 6/1991 Huang
5,038,812 A 8/1991 Norman
5,056,172 A 10/1991 Kaiser et al.
5,059,463 A 10/1991 Peters
D325,489 S 4/1992 Pratt
5,116,273 A 5/1992 Chan
5,163,192 A 11/1992 Watson
5,163,461 A 11/1992 Ivanovich et al.
D331,482 S 12/1992 Mitchell
5,206,964 A 5/1993 Wilson, Sr.
5,213,147 A 5/1993 Zheng
5,261,131 A 11/1993 Kilby
5,299,331 A 4/1994 Badillo
D349,593 S 8/1994 Hensley
5,345,627 A 9/1994 Cammarata
5,396,917 A 3/1995 Hazinski et al.
5,430,980 A 7/1995 Ferrier
5,433,433 A 7/1995 Armell
5,435,024 A 7/1995 Capshaw
5,435,025 A 7/1995 Gerard et al.
5,454,643 A 10/1995 Sullivan
5,467,794 A 11/1995 Zheng
5,473,785 A 12/1995 Lager et al.
D366,177 S 1/1996 Dean
5,499,417 A 3/1996 Wang
5,533,653 A 7/1996 Kaufman
5,560,385 A 10/1996 Zheng
5,579,799 A 12/1996 Zheng
5,592,961 A 1/1997 Chin
5,618,110 A 4/1997 Sullivan
5,618,246 A 4/1997 Zheng
5,619,759 A 4/1997 Hansen et al.
5,628,264 A 5/1997 Adamski et al.
RE35,571 E 7/1997 McLeese
5,644,807 A 7/1997 Battistella
5,688,052 A 11/1997 Compton
5,693,398 A 12/1997 Granger
D389,362 S 1/1998 Boulatian
5,729,846 A 3/1998 Sullivan
5,730,529 A 3/1998 Fritz et al.
5,732,759 A 3/1998 Wang
D400,749 S 11/1998 Bechtold, Jr.
5,976,023 A 11/1999 Cho
6,030,300 A 2/2000 Zheng
D425,357 S 5/2000 Waring
D426,415 S 6/2000 Le Gette et al.
6,073,283 A 6/2000 Zheng
6,170,100 B1 1/2001 Le Gette et al.
6,179,038 B1 1/2001 Eskandry
6,192,635 B1 2/2001 Zheng
6,199,229 B1 3/2001 Wong
D447,661 S 9/2001 Le Gette et al.
D449,193 S 10/2001 Le Gette et al.
6,343,391 B1 2/2002 Le Gette et al.
6,357,510 B1 3/2002 Zheng
D458,792 S 6/2002 Le Gette et al.
D459,135 S 6/2002 Laine et al.
D459,934 S 7/2002 Le Gette
6,485,344 B2 11/2002 Arias
6,519,793 B2 2/2003 Le Gette et al.
6,595,227 B2 7/2003 Le Gette et al.
6,672,323 B2 1/2004 Gupta et al.
7,000,270 B2 * 2/2006 Le Gette et al. ..... 5/417

* cited by examiner

COLLAPSIBLE MAT WITH REMOVABLE PORTION AND METHOD OF MAKING SAME

CROSS REFERENCE TO RELATED APPLICATION

This application is a continuation of U.S. application Ser. No. 10/778,341, filed on Feb. 17, 2004, entitled "Collapsible Mat With Removable Portion And Method Of Making Same," now U.S. Pat. No. 7,000,270, which is a continuation of U.S. application Ser. No. 10/358,303, filed on Feb. 5, 2003, entitled "Collapsible Mat With Removable Portion And Method of Making Same," now U.S. Pat. No. 6,691,344, which is a divisional of U.S. patent application Ser. No. 09/907,442, filed Jul. 18, 2001, entitled, "Collapsible Mat With Removable Portion And Method Of Making Same," now U.S. Pat. No. 6,519,793; all of which are incorporated by reference herein.

This application is related to the U.S. Ser. No. 09/533,963, entitled "Towel Mat with a Frame Member and Removably Attached Membranes," filed on Mar. 23, 2000, now U.S. Pat. No. 6,343,391, the disclosure of which is incorporated herein by reference.

BACKGROUND

Field of the Invention

This invention relates generally to a mat having multiple configurations, and in particular, to a mat that can be positioned in an expanded configuration and a collapsed configuration and having a removable portion.

SUMMARY OF THE INVENTION

A collapsible apparatus is provided that includes a frame configured to form a closed loop, the frame being moveable between a coiled configuration and an uncoiled configuration. A sleeve is configured to receive the frame and to define an opening within at least a portion of the closed loop. An attachment mechanism is coupled substantially about the periphery of the sleeve. A fabric member is removably coupled to the sleeve such that it is easily removed.

A method of making mats according to an embodiment of the invention includes cutting fabric members from a first sheet of material, cutting body membranes from a second sheet of material such that the amount of excess material from the second sheet of material between adjacent body membranes is minimized, and attaching one of the body membranes to one of the fabric members.

DETAILED DESCRIPTION

Embodiments of the present invention relate to a mat having a collapsible frame. Such a mat can have, for example, a collapsed configuration and an expanded configuration. The mat can be configured so that a body membrane (e.g., a membrane having a terry cloth portion) can be removably attached to the frame. This thereby allows the frame to retain the location and shape of the body membrane while in an expanded configuration. Because the body membrane can be removably attached, the body membrane can be washed without being attached to the frame, and then reattached to the frame for subsequent use. There are many ways to configure the mat and its attachment mechanisms (by which a body membrane can be attached). Many of these possible embodiments are described below.

In one embodiment, a mat includes a frame formed from a flexible, twistable material. The frame is configured to form a closed loop and is movable between a coiled configuration and an uncoiled configuration. A sleeve is configured to receive the frame and to define an opening within at least a portion of the closed loop of the frame. An attachment mechanism is coupled substantially about the periphery of the sleeve. A fabric member is couplable to the sleeve within the opening.

In yet another embodiment, the frame is coupled to an interface membrane(s) to which an attachment mechanism can be coupled. Such an interface membrane(s) can be, for example, one or more portions of fabric attached to the frame and to which the attachment mechanisms can be coupled. The interface membrane(s) need not completely cover or encapsulate the portions of the frame to which the interface membrane(s) are attached. For example, the attachment mechanisms can be strips of fabric each of which has one end glued to the frame and the other end with an attachment mechanism such as a portion of a snap connector, a portion of a hook and pile connection, etc. In such an embodiment, the body membrane can have a complimentary connector so that the body membrane is retained within the opening defined by the frame while the mat is in an expanded configuration.

The term "fabric member" is used here in to include, but is not limited to, a layer of material. For example, the fabric member can be a piece of fabric such as terrycloth or nylon. In one embodiment, the fabric member may include multiple layers of fabric that may or may not be similar materials. In other embodiments, the fabric member can include a non-floatation portion (e.g., a cushion or a raised support structure) or a floatation portion, such as for example, an inflatable bladder, inflatable cushion or inflatable pillow.

Figure 1:
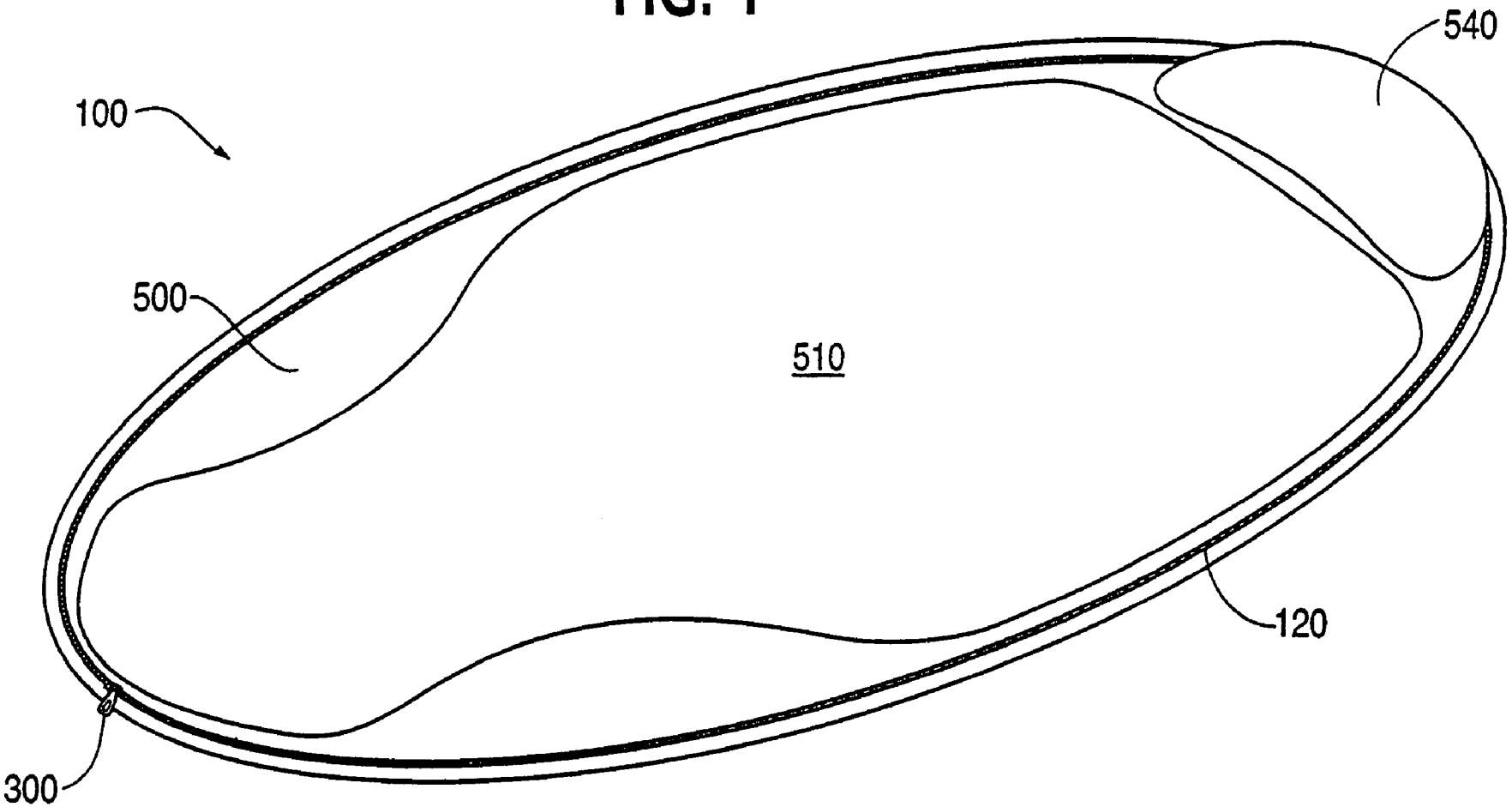
FIG. 1 illustrates a perspective view of a mat according to an embodiment of the invention.

Referring to FIGS. 1, 2, 3 and 7, an embodiment of the collapsible apparatus of the present invention is illustrated. FIG. 1 illustrates collapsible apparatus 100 in its assembled state in which the fabric member 500 is coupled to sleeve 120 by an attachment mechanism 300. In the illustrated embodiment, the attachment mechanism 300 is a zipper that is located about a perimeter of opening 200 that is defined by sleeve 120. Alternatively, the attachment mechanism may be located about an outer perimeter of sleeve 120 or at a location between the outer portion of sleeve 120 and the perimeter of the opening 200.

Figure 2:
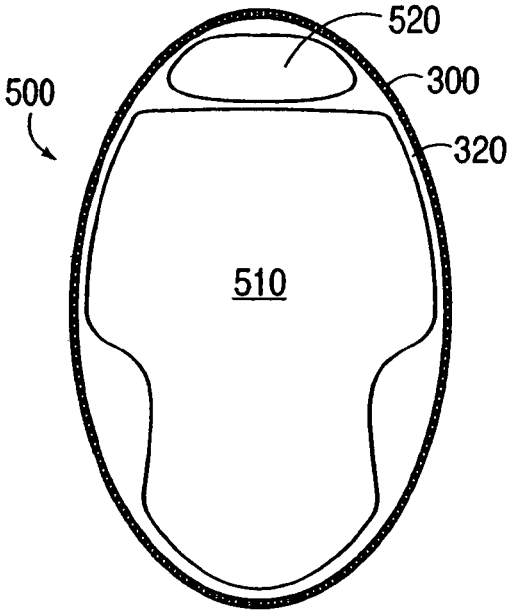
FIG. 2 illustrates a removable membrane for use with the mat shown in FIG. 1.
Figure 3:
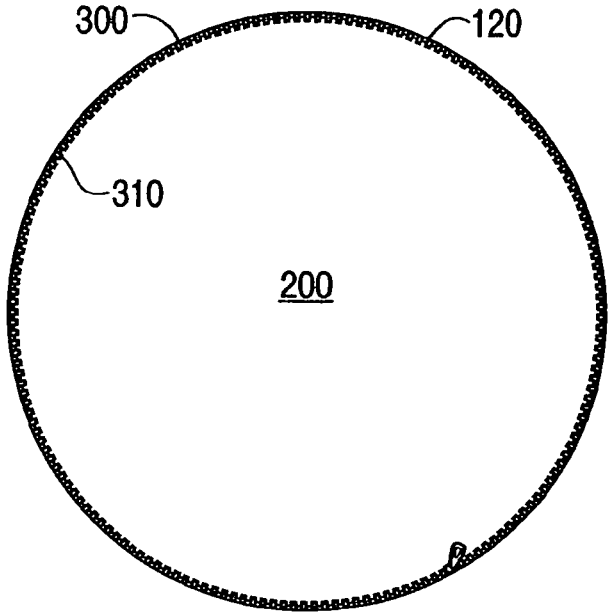
FIG. 3 illustrates a frame for use with the mat shown in FIGS. 1 and 2.

FIGS. 2 and 3 illustrate collapsible apparatus 100 in its unassembled state in which the fabric member 500 is removed from the sleeve 120. When the fabric member 500 is coupled to the sleeve 120 as illustrated in FIG. 1, the frame 110 takes a different shape than when the fabric member 500 is removed from sleeve 120 as illustrated in FIG. 3. More specifically, when the fabric member 500 is removed from sleeve 120 as illustrated in FIG. 3, the frame 110 returns to its untensioned, circular configuration and when the fabric member 500 is attached to the sleeve 120, the frame 110 takes the shape of the fabric member 500, such as an oval (as shown in FIG. 1).

Alternatively, the frame 110 may be manufactured from a shape retaining material that allows the frame 110 to maintain its oval configuration regardless of whether the fabric member 500 is coupled to the sleeve 120. Such a shape retaining material can allow frame 110 to maintain shapes other than circular or oval, such as for example, an oval with squared corners.

The fabric member 500 may include a body member 510 on which a user's body may be positioned during use of the apparatus 100. The fabric member 500 may also include a pillow membrane 520 for receiving a pillow or similar structure configured to support the head of a user. Alternatively, a pillow or other raised support member may be coupled to, integrally formed with or removably attachable with the fabric member 500 to support a user's head. The body membrane 510, and the pillow membrane 520 may be, for example, similar materials and may be different than the material used to make the fabric member 500.

The attachment mechanism 300 includes a first portion 310 that is coupled to the sleeve 120 and a second portion 320 that is coupled the fabric member 500. The first portion 310 and second portion 320 are, for example, mating fasteners used to retain the position of the fabric member relative to the sleeve 120. The attachment mechanism 300 can be, for example, zippers and/or other attachment devices such as hook and loop fasteners, buttons, snaps, and/or clips that may be disposed around the periphery of sleeve 120 (or portions of the periphery of sleeve 120) to retain the position of the fabric member 500 relative to the sleeve 120.

FIGS. 16 through 20 show an example of a process by which a mat is transformed from an uncoiled configuration to a coiled configuration. Of course, the process can be reversed to illustrate the process of transforming the mat from a coiled configuration to an uncoiled configuration by following FIGS. 16 through 20 in reverse order.

Figure 18:
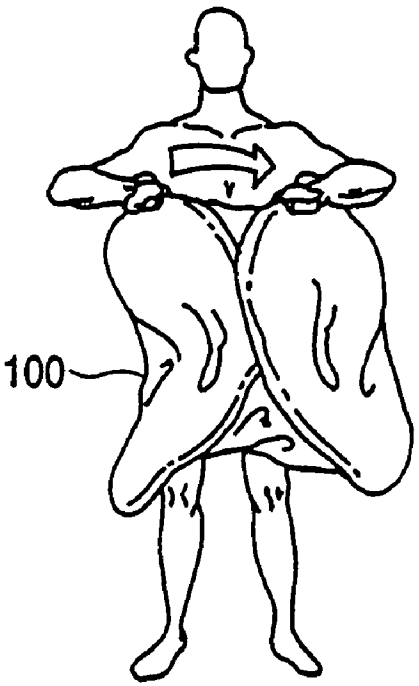
FIGS. 16 through 20 show an example of a process by which a mat is transformed from an uncoiled configuration to a coiled configuration.
Figure 17:
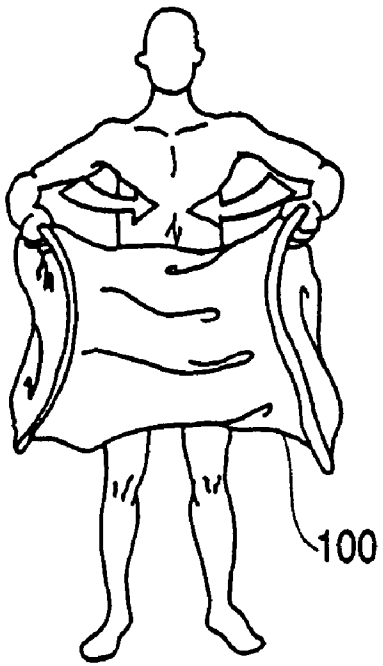
Figure 16:
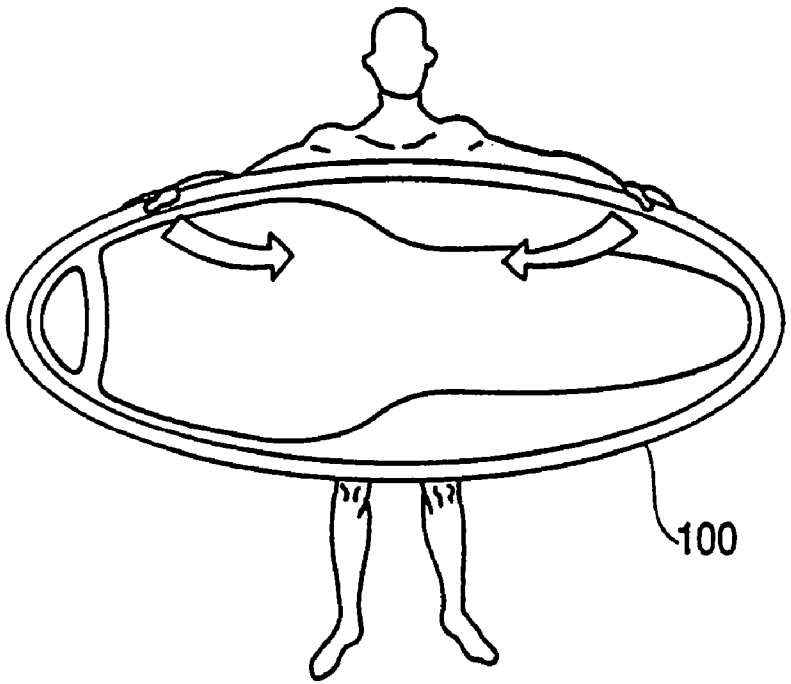
Figure 19:
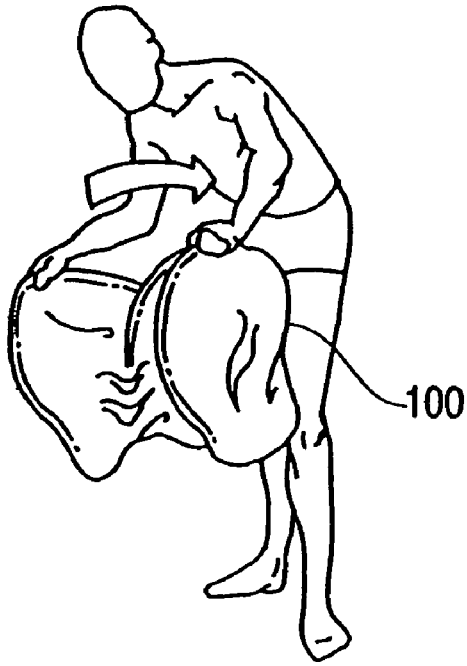
Figure 20:
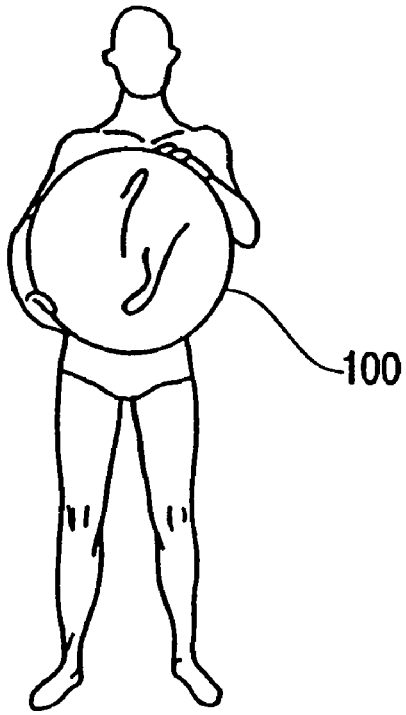

As shown in FIG. 16, a person can hold the edge of the mat 100 at approximately 2 o'clock and 10 o'clock. The mat 100 can be oriented in any manner such as, for example, where its longer side lies across from 3 o'clock to 9 o'clock (as shown in FIG. 16). As shown in FIG. 17, the ends of mat 100 along the longer side can then be folded toward the center, away from the person. As shown in FIG. 18, one end of the mat 100 can be further brought towards the center. As shown in FIG. 19, the remaining end of mat 100 can then be folded over so that mat 100 is folded into, for example, a substantially circular shape approximately one-nine the area of the mat when in an unfolded configuration, as shown in FIG. 20.

Figure 4:
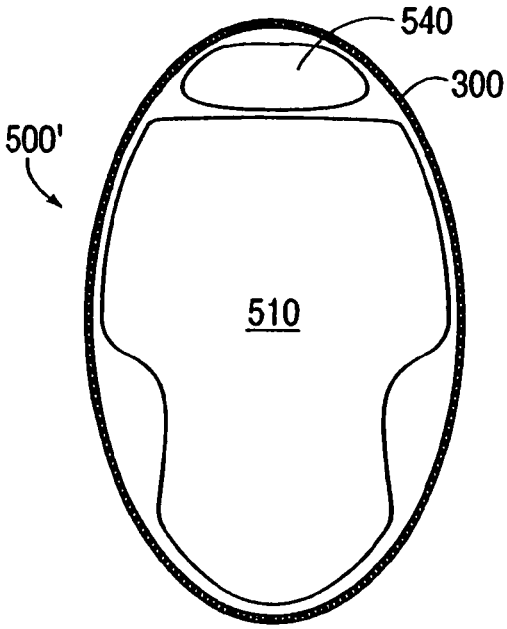
FIG. 4 illustrates a removable membrane for use with the mat according to a further embodiment of the invention.
Figure 5:
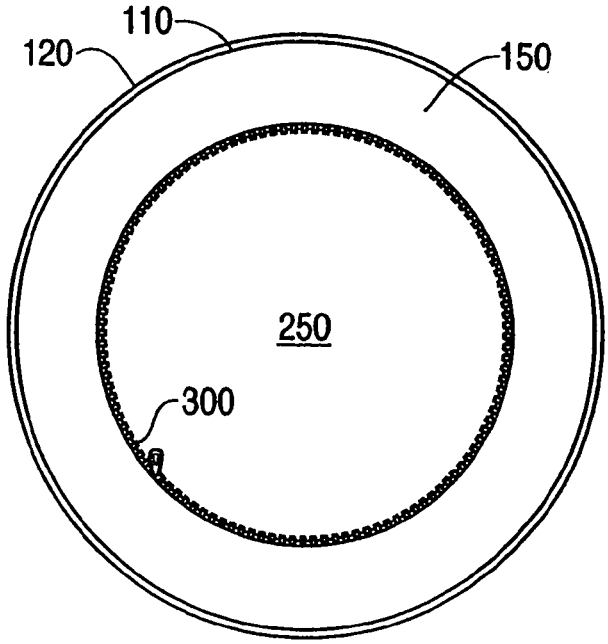
FIG. 5 illustrates a frame for use with the mat shown in FIG. 4.
Figure 6:
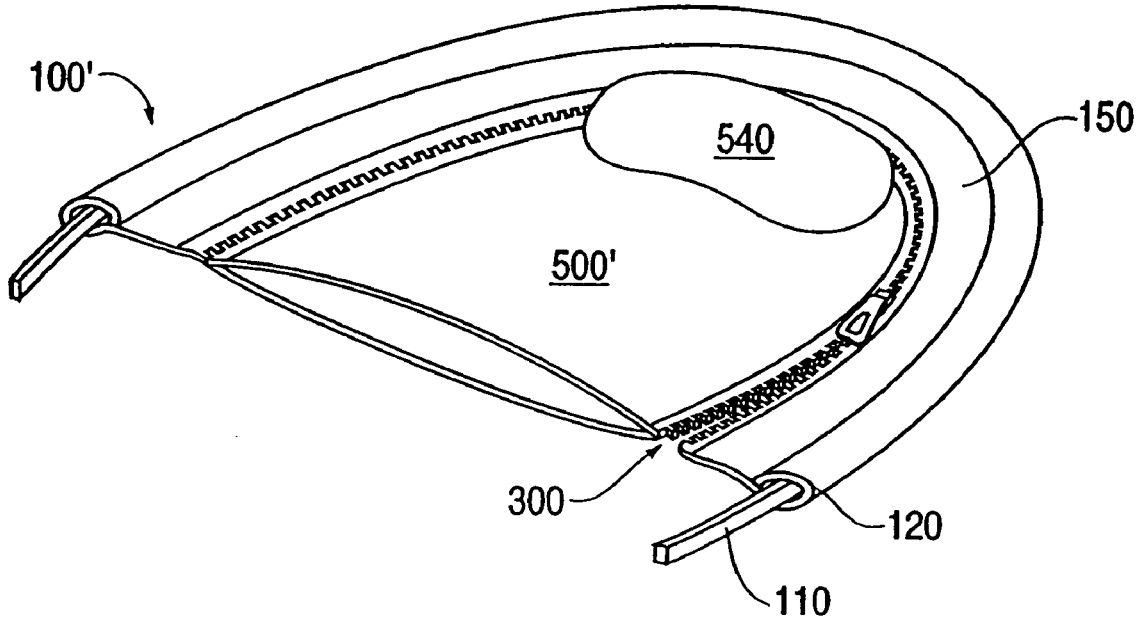
FIG. 6 illustrates a partial cut-away perspective view of the mat illustrated in FIGS. 4 and 5.
Figure 7:
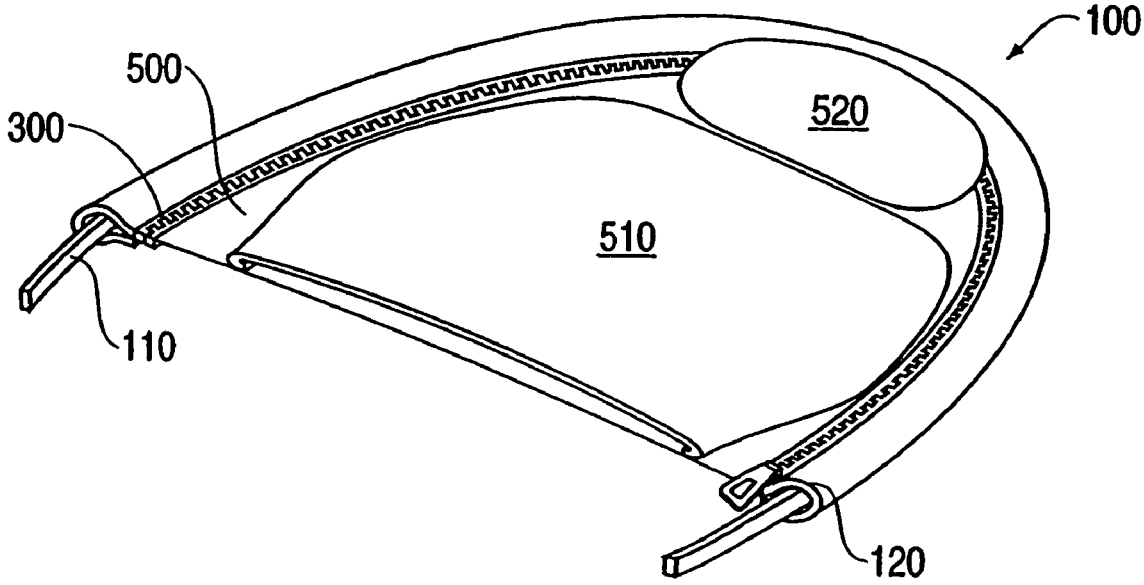
FIG. 7 illustrates a partial cut-away perspective view of the mat illustrated in FIG. 1.

Referring to FIGS. 4, 5 and 6, another embodiment of the invention is illustrated in which the mat 100' includes an interior membrane 150 coupled to sleeve 120 within the opening 200 (i.e., the interior periphery about sleeve 120). The interior membrane 150 defines a second opening 250. The attachment mechanism 300 may be located around the perimeter of the opening 250, for example, located on the interior membrane 150 as illustrated. A fabric member 500' is removably couplable to the interior membrane 150. In the embodiment illustrated in FIGS. 4 and 6, a raised support member 540 is located on the fabric member 500'. Alternatively, the raised support structure may be located on interior membrane 150 such that when the fabric member 500' is removed from the interior membrane 150, the raised support member remains on the interior membrane 150.

The shape and size of interior membrane 150 can affect the shape that the frame 110 can take when the fabric member 500' is removed from interior membrane 150. For example, where the interior membrane 150 has a relatively small radial width, the frame 110 can return to its original, untensioned configuration (similar to the embodiment illustrated in FIGS. 1–3 and 7). Alternatively, where the interior membrane 150 has a sufficiently large radial width, the frame 110 can maintain a shape defined by the tension provided by the interior membrane 150 when the fabric member 500' is removed from the interior membrane 150 (as shown in FIG. 5 where the frame 110 maintains a more oval-like shape).

Figure 8:
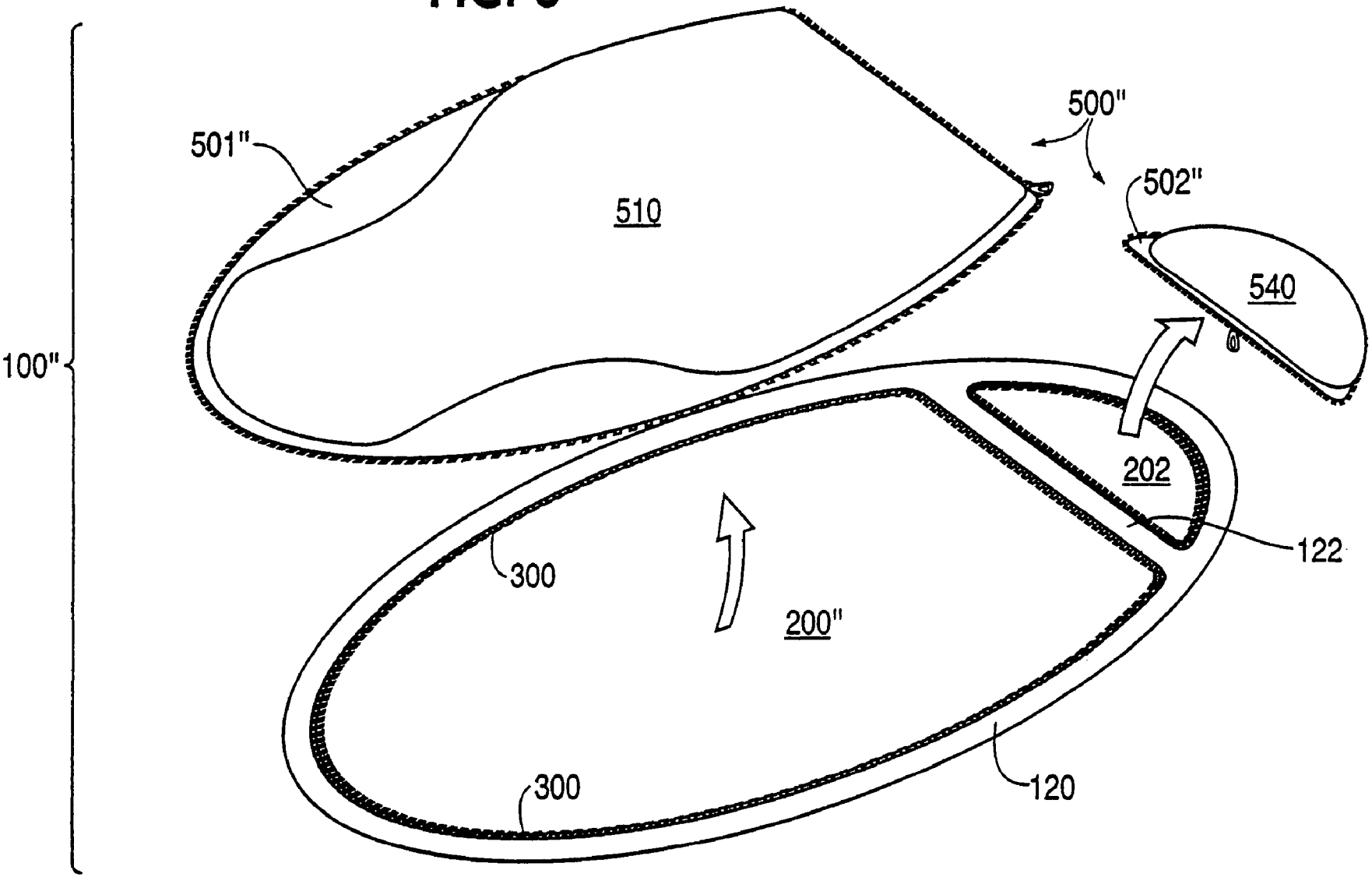
FIG. 8 illustrates an assembly view of a mat according to another embodiment of the invention.

FIG. 8 illustrates an assembly view of a mat according to another embodiment of the invention. In the illustrated embodiment, the mat 100" includes a frame 110 (not shown in FIG. 8) retained within a sleeve 120. The oval-like shape defined by the sleeve 120 is bisected at one end by a dividing element 122 to define two openings 200" and 202. A fabric member 500" is separated into a first portion 501 " and a second portion 502", each of which is separately removable from the sleeve 120. The first portion 501" is configured to be removably coupled to the sleeve 120 proximate to opening 200" and the second portion 502" is configured to be removably coupled to the sleeve 120 proximate to opening 202. Alternatively, either portion 501" or 502" may be permanently coupled to the sleeve 120. A body membrane 510 is disposed on the first portion 501" and a pillow membrane 520 or a raised support member 540 may be disposed on the second portion 502". The body membrane 510 can be constructed from, for example, a terry cloth material and disposed on the first portion 501", which can be constructed from, for example, a nylon material.

Figure 9:
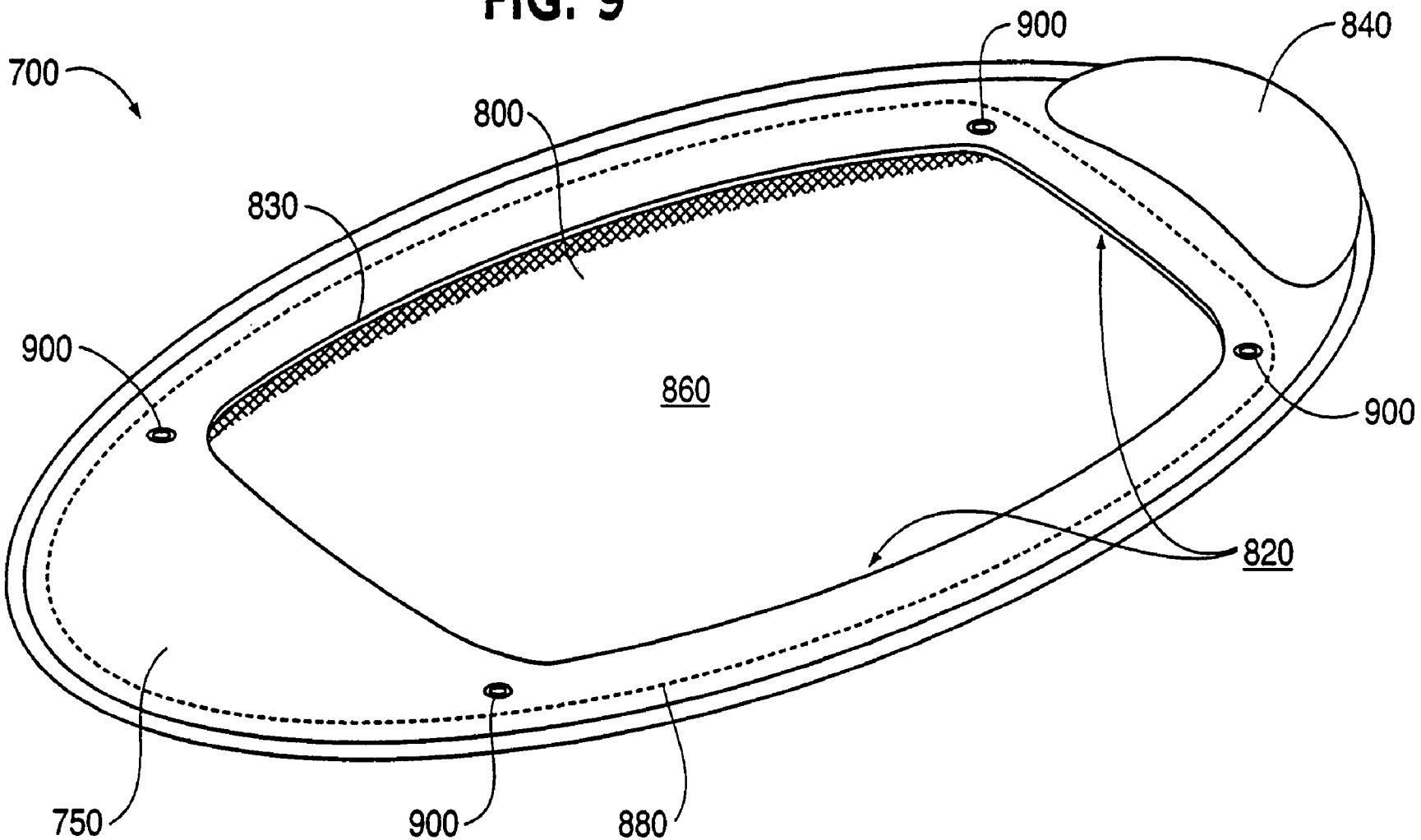
FIG. 9 illustrates a perspective view of a mat according to a further embodiment of the invention.
Figure 10:
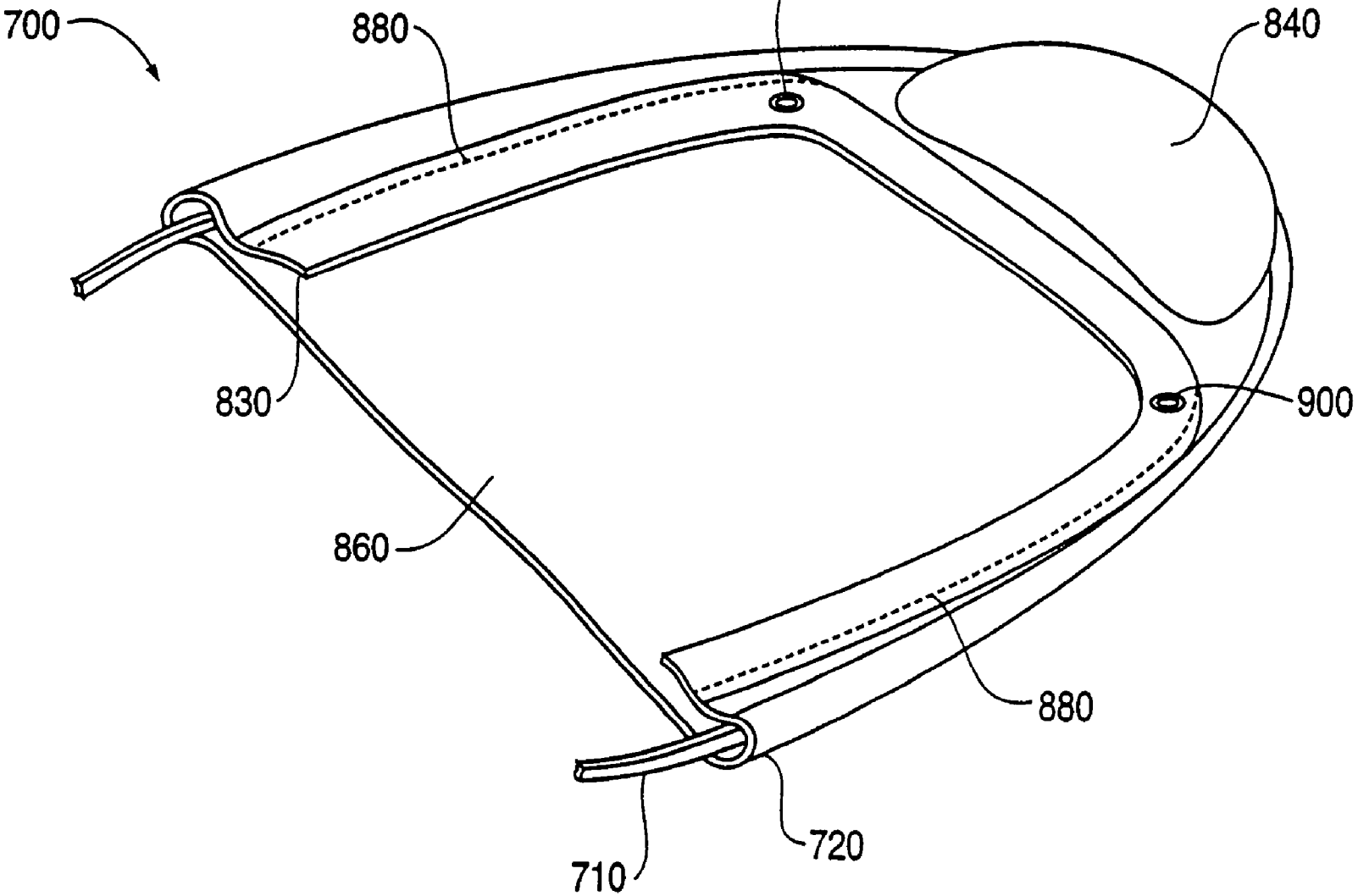
FIG. 10 illustrates a partial cut-away perspective view of the mat illustrated in FIG. 9.

FIGS. 9 and 10 show another embodiment of the present invention. In the illustrated embodiment, the mat 700 includes a frame 710 that is formed from a flexible, twistable material. The frame 710 is configured to form a closed loop and is movable between a coiled and an uncoiled configuration. A sleeve 720 is configured to receive at least a portion of the closed loop of the frame 710. An interior membrane 750 extends from the sleeve 720 and defines an opening 820. An attachment mechanism 900 is coupled to the interior membrane 750 and is configured to maintain the position of a body membrane (not shown), such as for example a conventional beach towel, with respect to the sleeve 720. A base member 860 extends substantially across the opening 820 to provide a protective layer between the body membrane that can be placed in the mat 700 and a supporting surface (not shown) upon which the mat 700 is located (e.g., the ground or beach). A pillow or similar raised support member 840 may be coupled to the mat 700. The body membrane for use with the preset embodiment can include, for example, any flexible membrane such as terrycloth and/or nylon.

Note that attachment mechanism 900 is optional. An alternative embodiment without an attachment mechanism, for example, can retain a body membrane between base member 860 and interior membrane 750 by a frictional fit.

In the illustrated embodiment, the attachment mechanism comprises a plurality of attachment mechanisms (e.g., holes) 900 adjacent the perimeter of the opening. The attachment mechanisms 900 are situated on a pocket 830 that is defined by stitching 880 that surrounds the opening 820. The pocket 830 may be formed by other means known to those skilled in the art such as hook and loop fasteners, adhesive, etc. Alternatively, the attachment mechanism 900 may include, for example, one or more holes each configured to receive a corner of a towel that is used as a body membrane. Attachment mechanism 900 may also include one or more slits (not shown) that may receive opposite ends of a towel. In yet another alternative embodiment, the attachment mechanism can be a combination of the above-mentioned mechanisms.

In operation, a user places a body membrane (e.g., a towel or the like) within the pocket 830 and passes the corners of the towel up through the attachment mechanisms (e.g., holes) 900 to maintain the towel in position. The ends of the body membrane may then be secured such that they don't pass back through the attachment mechanisms 900 by a variety of methods known to those skilled in the art. For example, the ends of the towel can be retained within attachment mechanisms 900 by a frictional fit. Alternatively, the ends of the body membrane that are passed through the attachment mechanism can be tied in a knot to prevent the body membrane from passing back through the attachment mechanism. Alternatively, a cap or some other securing device may be attached to the body membrane and secured to the attachment mechanisms 900. Additionally, a grommet may be positioned in the attachment mechanism, for example, to prevent the pocket 830 from being torn.

In yet another alternative, the attachment mechanism can have a portion on interior membrane 750 and another portion on base member 860. In such an embodiment, the attachment mechanism can be, for example, a snap where the body membrane is snapped between the two portions of the snap. In a similar embodiment, the attachment mechanism can be a pair of hoop connectors of different sizes. In this embodiment, the body membrane can be retained with the pair of hoop connectors by snapping the pair of hoop connectors around body membrane (disposed between the two hoop connectors).

Figure 11:
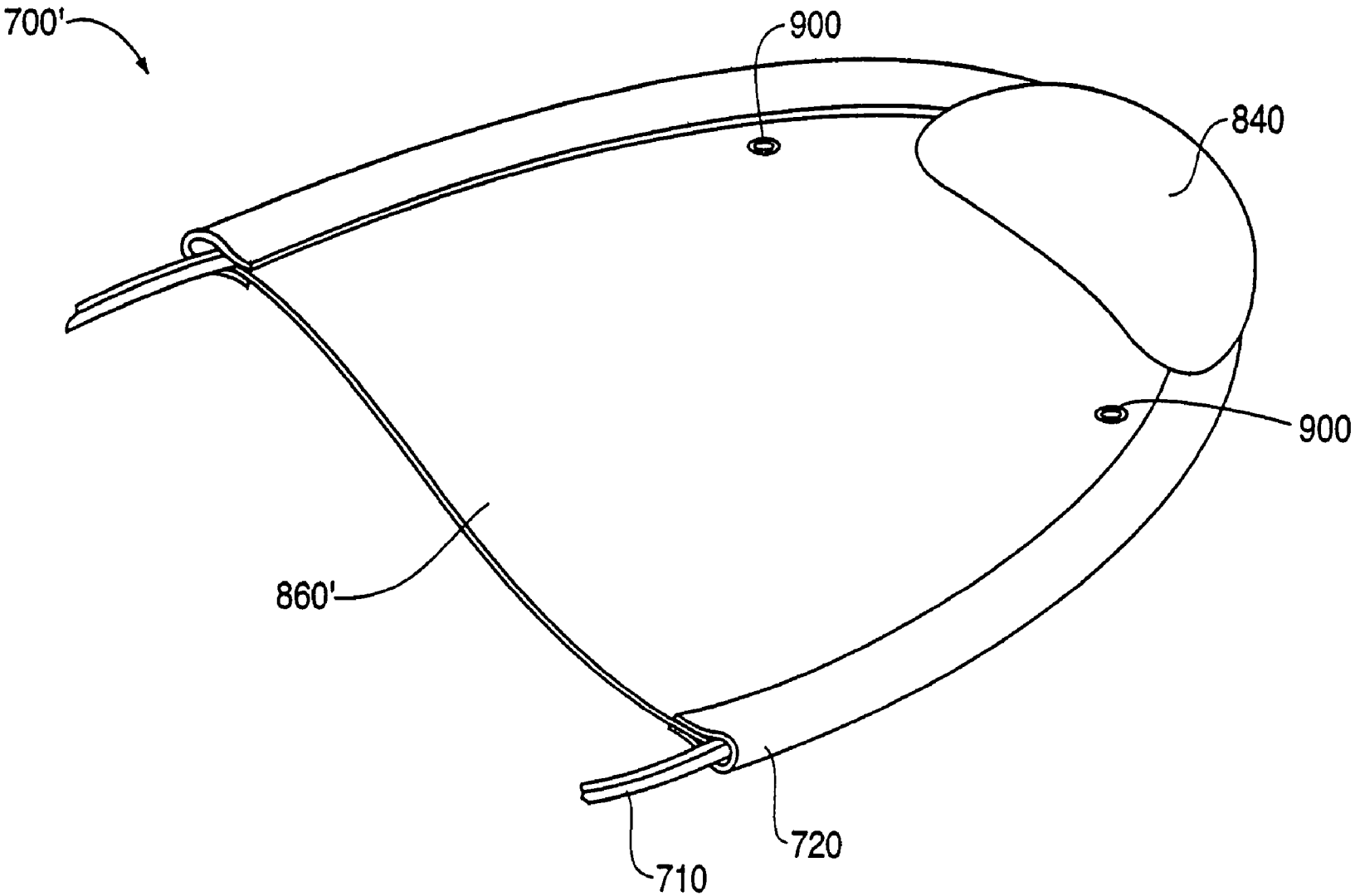
FIG. 11 illustrates a partial cut-away perspective view of a mat according to another embodiment of the invention.

Another embodiment of the present invention is illustrated in FIG. 11. As shown in FIG. 11, the mat 700' includes a frame 710 that is formed from a flexible, twistable material. The frame 710 is configured to form a closed loop and is movable between a coiled and an uncoiled configuration. A sleeve 720 is configured to receive at least a portion of the closed loop of the frame 710. A base member 860' extends between opposite sides of the sleeve 720 to provide a protective layer between a body membrane (not shown) that can be placed in the mat 700' and a supporting surface upon which the mat 700' is located (e.g., the ground or beach). A pillow, or similar raised support member 840 can be coupled to the mat 700'. An attachment mechanism 900 is coupled to base member 860' and is configured to maintain the position of the body membrane (not shown), such as a conventional beach towel, with respect to the sleeve 720.

In the embodiment illustrated in FIG. 11, the attachment mechanism 900 comprises a plurality of openings (e.g., holes) as in the embodiment illustrated in FIGS. 9 and 10. In the present embodiment, however, the corners of the body membrane (not shown) are pushed through the attachment mechanism 900 towards (e.g., downward, into the page of FIG. 11) the supporting surface upon which the mat 700' is located as opposed to being pulled up through the holes by virtue of the position of the holes on the mat 700'.

Figure 12:
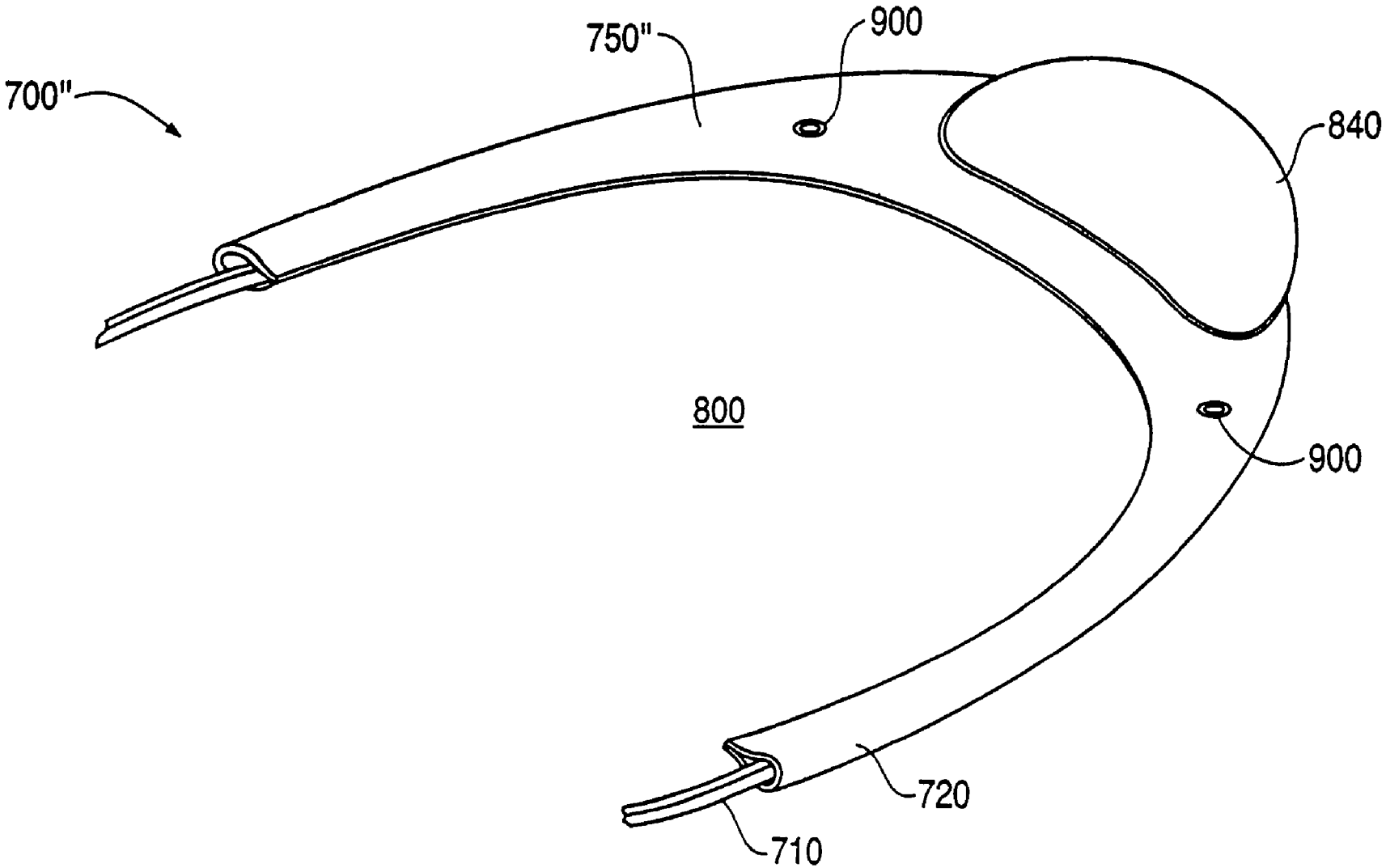
FIG. 12 illustrates a partial cut-away perspective view of a mat according to a further embodiment of the invention.

FIG. 12 shows yet another embodiment of the present invention. As shown in FIG. 12, a mat 700" includes a frame 710 that is formed from a flexible, twistable material. The frame 710 is configured to form a closed loop and is movable between a coiled and an uncoiled configuration. A sleeve 720 is configured to receive the frame 710 within at least a portion of the closed loop of the frame 710. The mat 700" further includes an interior membrane 750". The interior membrane 750" defines an opening 800 across which a body membrane (not shown) may be disposed. A raised support member 840 can be included on sleeve 720.

An attachment mechanism 900 is located on the interior membrane 750" and includes a hole configured to receive at least a portion of a body membrane as described above. The body membrane can be coupled to the attachment mechanism 900 such that the majority of the body membrane is located beneath the mat 700" and the corners of the body membrane extend upwardly through the attachment mechanism 900. Alternatively, the body membrane may be positioned such that the majority of the body membrane is located above the mat 700" and the corners of the body membrane extend downwardly through the attachment mechanism 900.

Figure 21:
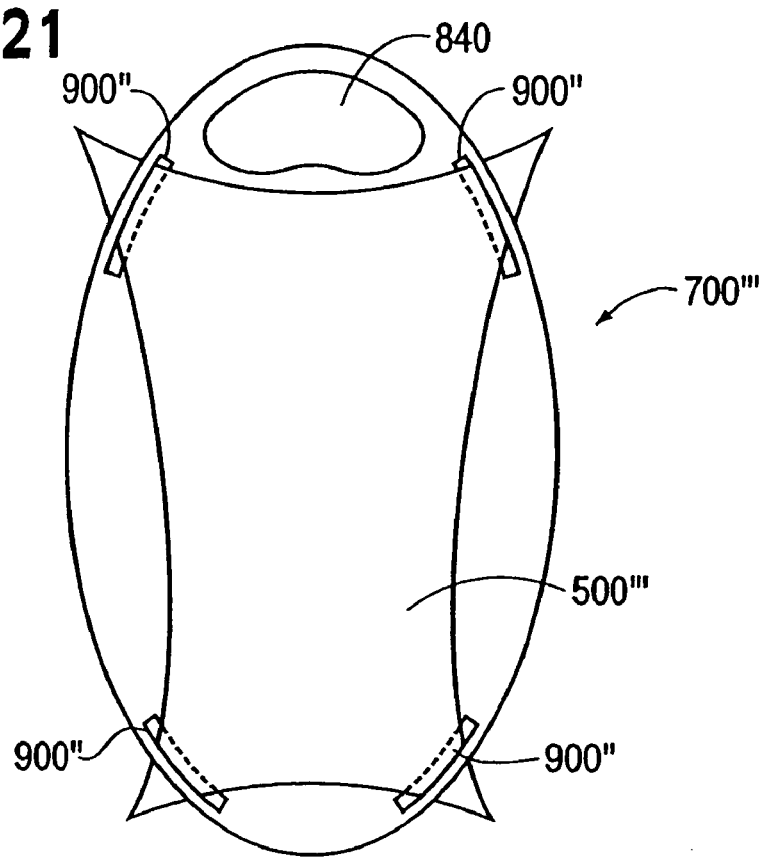
FIG. 21 illustrates a top view of a mat according to yet another embodiment of the invention.

FIG. 21 shows another embodiment of the present invention. As shown in FIG. 21, the mat 700''' includes a frame (not shown) within a sleeve (not shown). The mat 700''' includes a pillow or raised support member 840 and attachment mechanisms 900". The attachment mechanisms 900" can be, for example, straps (e.g., elastic straps) within which a body membrane 500''' can be retained within mat 700'''. Alternatively, the attachment mechanisms can be slots within the mat. In such an embodiment, a body membrane can be pulled down through the slots to retain the body membrane with the mat.

Figure 22:
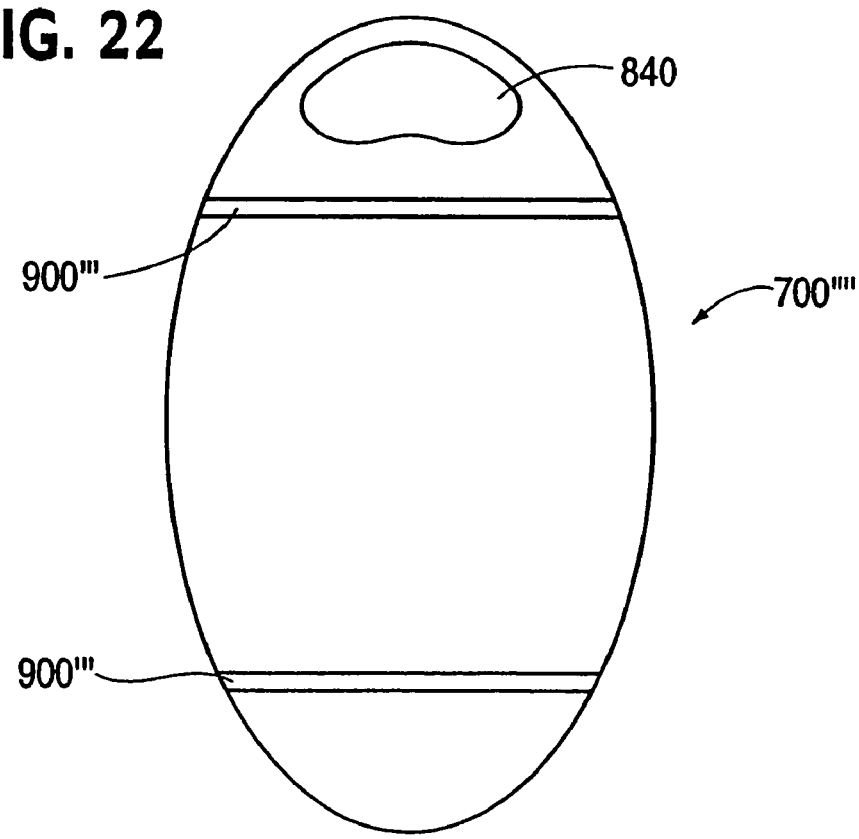
FIG. 22 illustrates a top view of a mat according to yet another embodiment of the invention.

FIG. 22 shows another embodiment of the present invention. As shown in FIG. 22, the mat 700'''' includes a pillow or raised support member 840 and attachment mechanisms 900'''. The attachment mechanisms 900''' can be, for example, straps (e.g., elastic straps) across the mat 700''''. A body membrane (not shown in FIG. 22) can be retained between mat 700''' and the attachment mechanisms 900'''. Although only two such attachment mechanisms 900''' are shown in FIG. 22, any number of such attachment mechanisms can be included.

Figure 13:
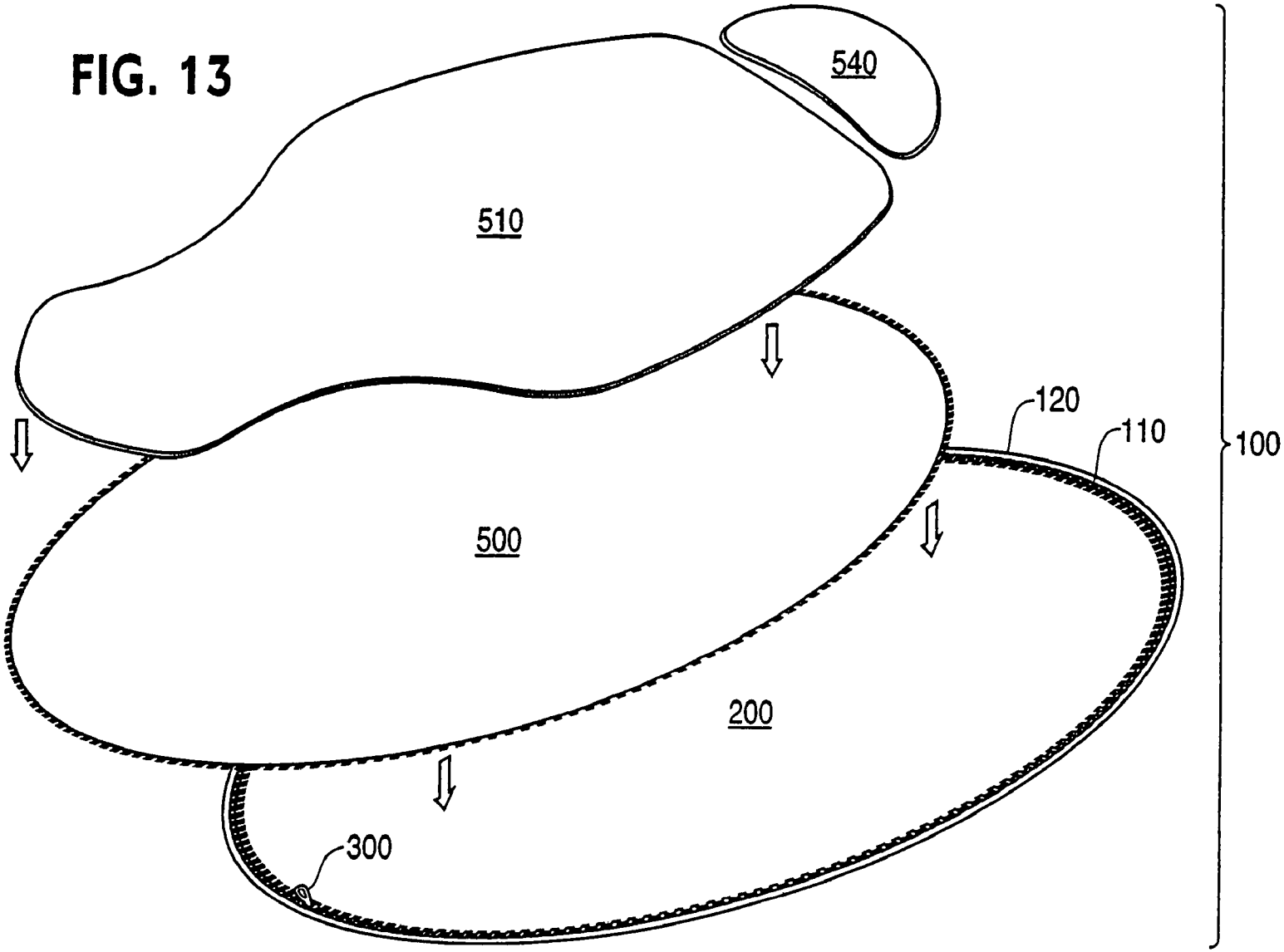
FIG. 13 illustrates an assembly view of the mat of FIG. 1.
Figure 14:
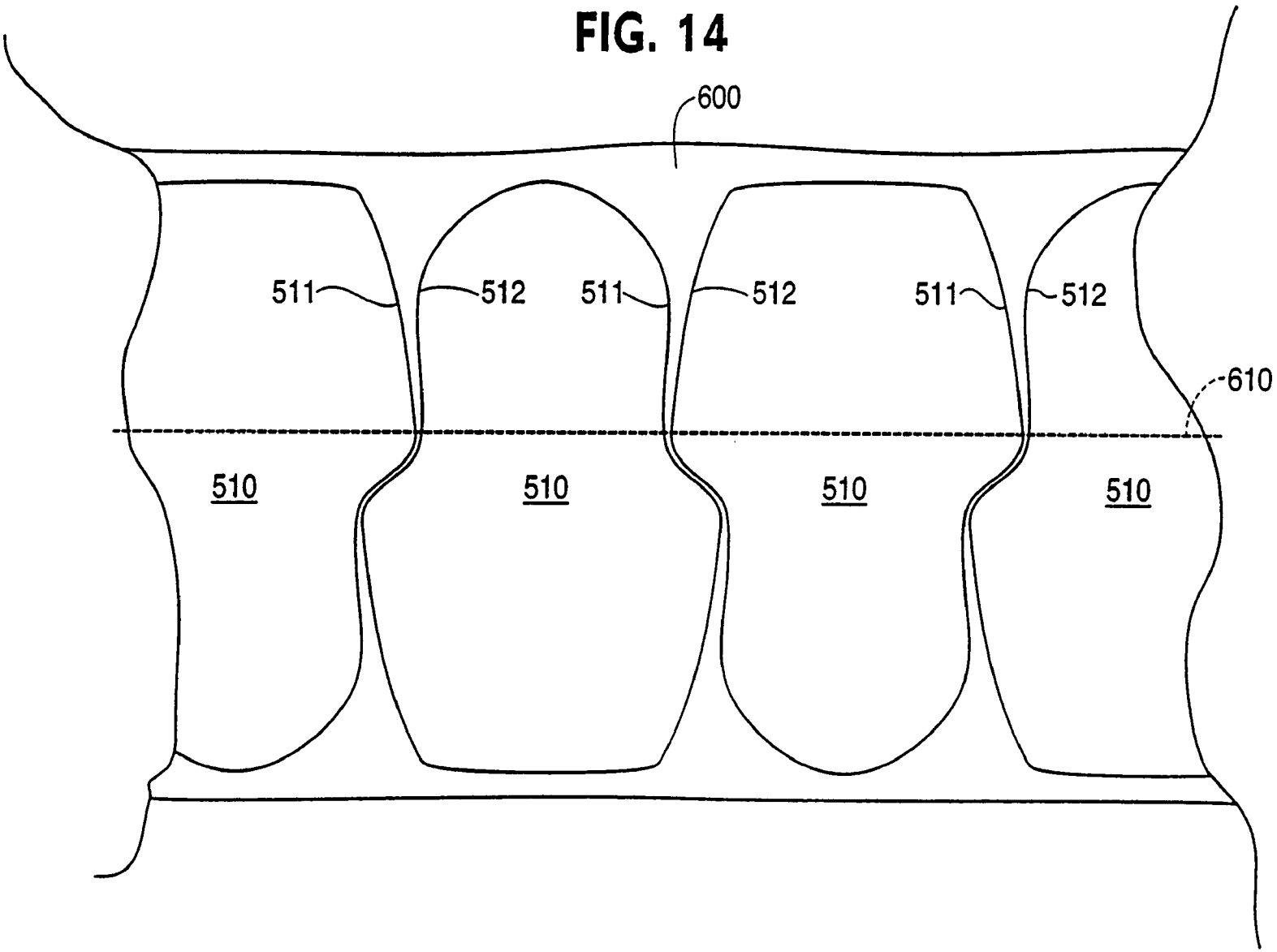
FIG. 14 illustrates a top view of body membranes to be cut from a sheet of material in accordance with a step in the method of making the mat according to embodiments of the invention.

A method of making mats, for example mat 100, is described in reference to FIGS. 13 and 14. The mat 100 is constructed by first cutting fabric members 500 from a sheet of material (not shown) and then cutting the body membranes 510 from another sheet of material 600 in such a manner that the amount of wasted material from the sheet of material 600 is minimized. After cutting the fabric members 500 and body membranes 510, a body membrane 510 is attached to each fabric member 500. The frame 110 is formed from a length of flexible twistable material and is encapsulated, at least in part, by fabric portions that are cut and dimensioned to encapsulate the frame 110. A fabric portion is stitched around each of the frames 110 such that a sleeve 120 is formed around at least a portion of each frame 110. An attachment mechanism is positioned about the periphery of the sleeve 120 as described above.

Referring to FIG. 14, the body membranes 510 are cut from the sheet of material 600 in such a manner that excess material is reduced. The amount of excess material that results between adjacent body membranes can be less than the amount of material that would result if the body membranes were, for example, oval in shape (as disclosed in, for example, U.S. Pat. No. 6,170,100, entitled "Self-opening Towel," the disclosure of which is incorporate herein by reference). By cutting the body membranes 510 from the sheet of material 600 and by configuring them so that opposing sides 511, 512 of adjacent body membranes are nested and substantially equidistant, the amount of waste of material sheet 600 is reduced significantly. Said another way, the sheet of material 600 has a centerline 610 along the length (i.e., the longer side) of the sheet of material 600; any two adjacent body membranes can be mirror images so that they form interlocking shapes. Such interlocking shapes reduce the amount of excess material of sheet 600.

The body membranes 510 may be cut from the sheet of material 600 such that at least a portion of sides 511, 512 of adjacent body membranes 510 are formed by a single cut (e.g., by a punch cut for each body membrane 510). By minimizing the wasted material from sheet 600, the overall cost of apparatus 100 is reduced. Mats 100' and 100" can be constructed in a manner similar to that described in reference to FIGS. 13 and 14.

Figure 15:
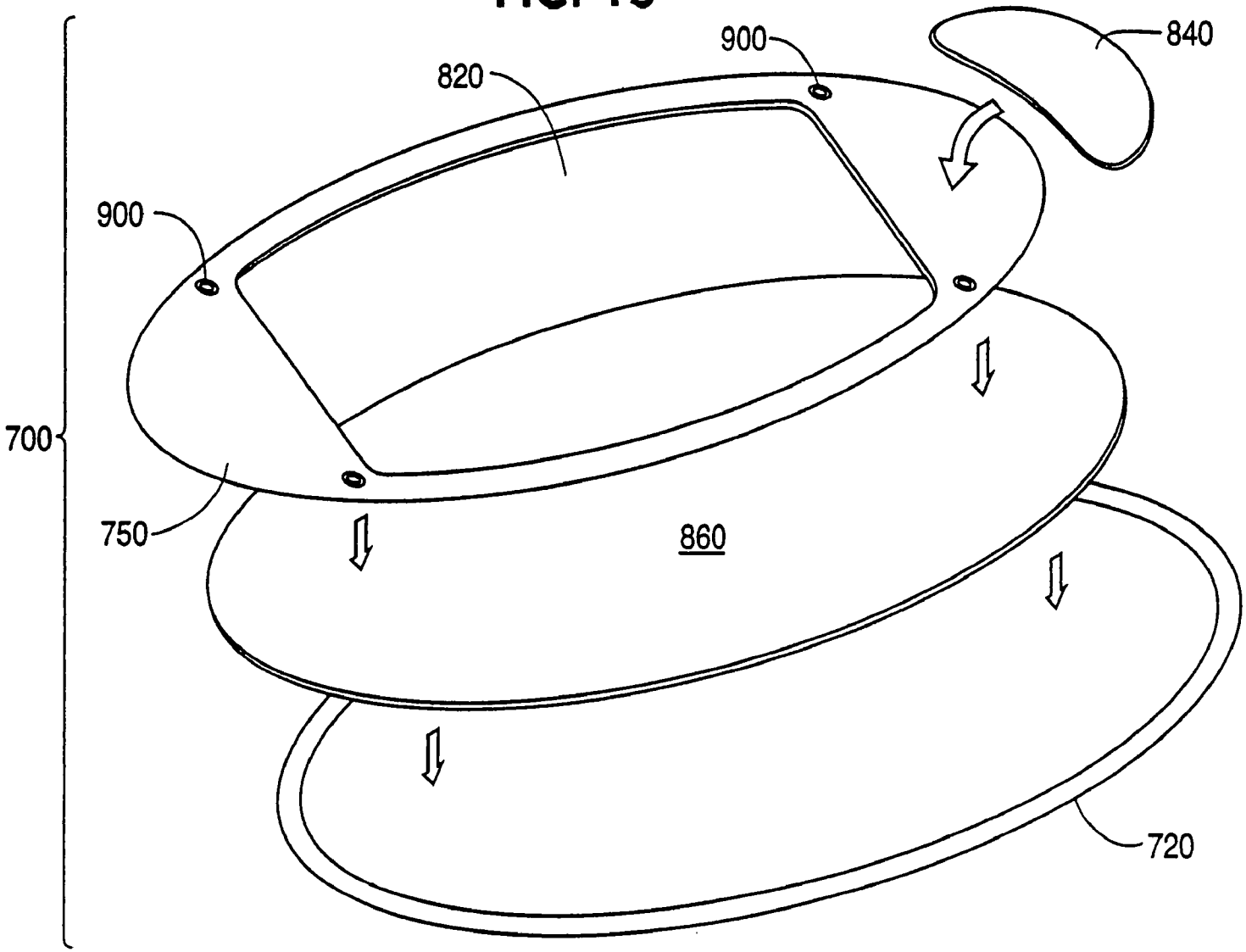
FIG. 15 illustrates an assembly view of the mat of FIG. 9.

FIG. 15 illustrates an assembly view of the mat 700. The mat 700 is constructed by first cutting interior membranes 750 from a sheet of material (not shown) and then by cutting the base member 860 from another sheet of material. The frame 710 (not shown in FIG. 15) is formed from a length of flexible twistable material and is encapsulated by fabric portions that are cut and dimensioned to encapsulate at least a portion of the frame 710. A fabric portion is stitched around each of the frames 710 such that a sleeve 720 is formed around each frame 710. Openings (or holes) can be formed in the interior membranes 820 to provide an attachment mechanism 900 as described above. Mat 700 is assembled by fastening the interior membrane 750, the base member 860 and the sleeve 120. Mat 700' can be assembled in a similar manner. Mat 700" also can be assembled in a similar manner, but the base member 860 is not included as would be apparent from the above discussion.

Figure 24:
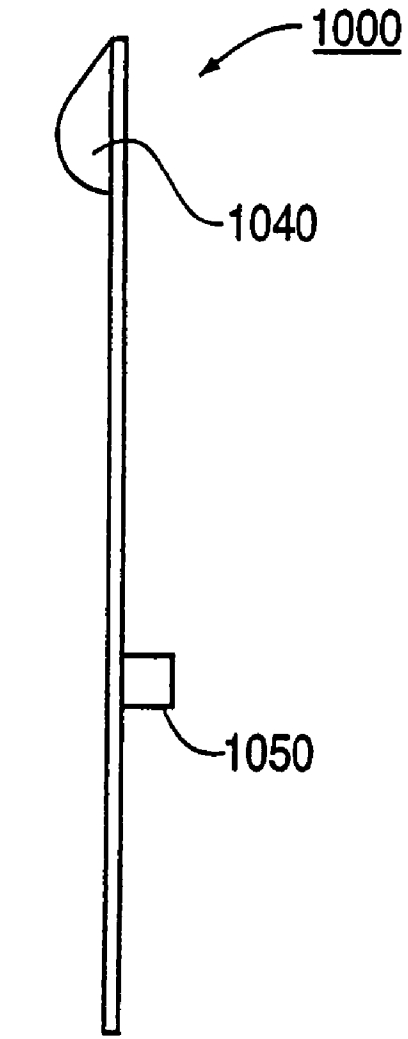
FIG. 24 illustrates a side view of the mat shown in FIG. 23.
Figure 23:
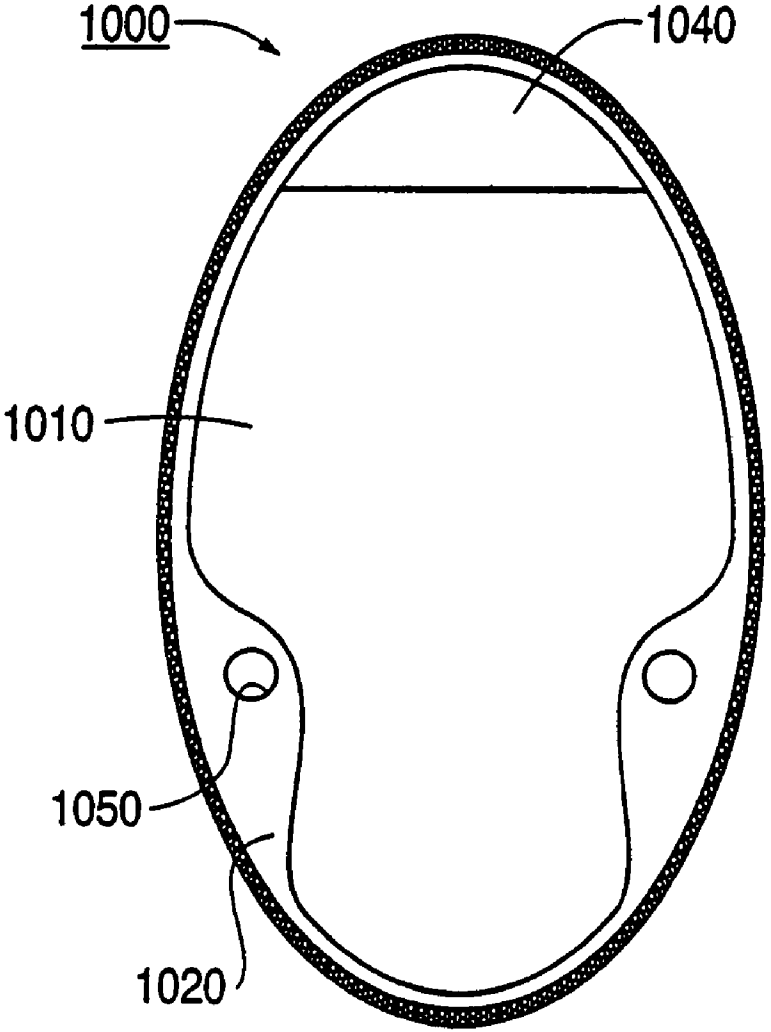
FIG. 23 illustrates a top view of a mat according yet another embodiment of the present invention.

FIG. 23 illustrates a top view of a mat according yet another embodiment of the present invention. FIG. 24 illustrates a side view of the mat shown in FIG. 23. As shown in FIGS. 23 and 24, the mat 1000 includes a fabric member 1020, a body membrane 1010 and a raised support structure 1040. In addition, mat 1000 includes a cup holder 1050 within the fabric member 1020. When the mat 1000 is in an expanded configuration and disposed on a beach for example, the cup holder 1050 can be disposed below the mat 1000 and within the sand of the beach. In alternative embodiments, the cup holder is disposed within other locations within the fabric member, for example, near the raised support structure.

Figure 27:
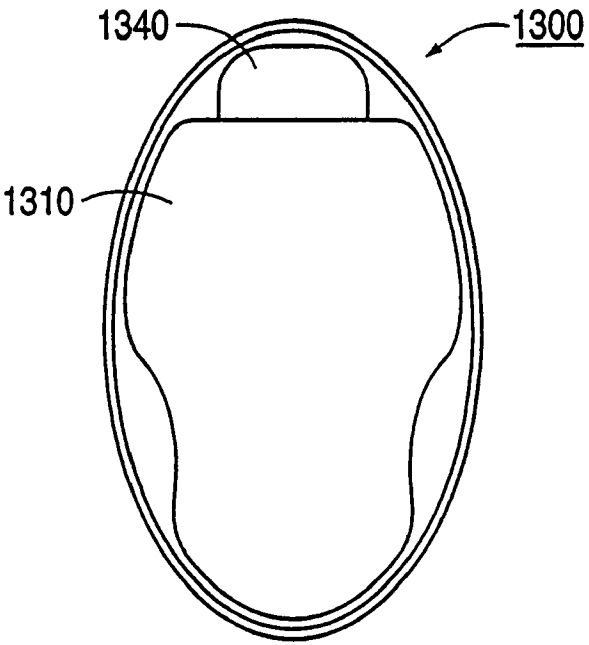
FIG. 27 illustrates a top view of a mat according to yet another embodiment of the present invention.
Figure 26:
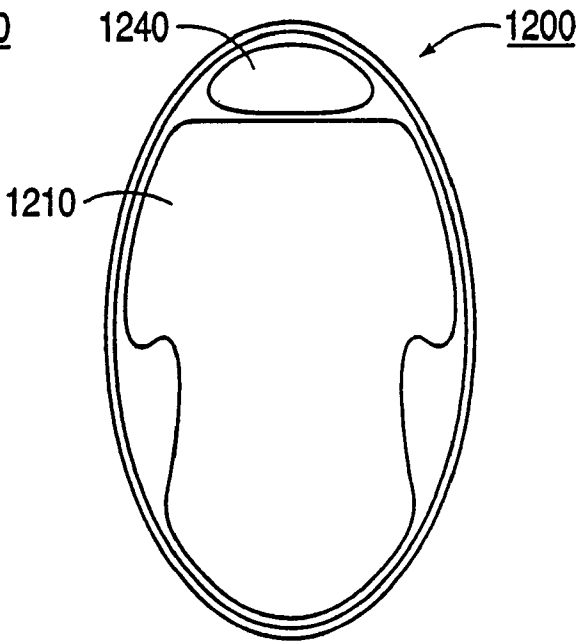
FIG. 26 illustrates a top view of a mat according to yet another embodiment of the present invention.
Figure 25:
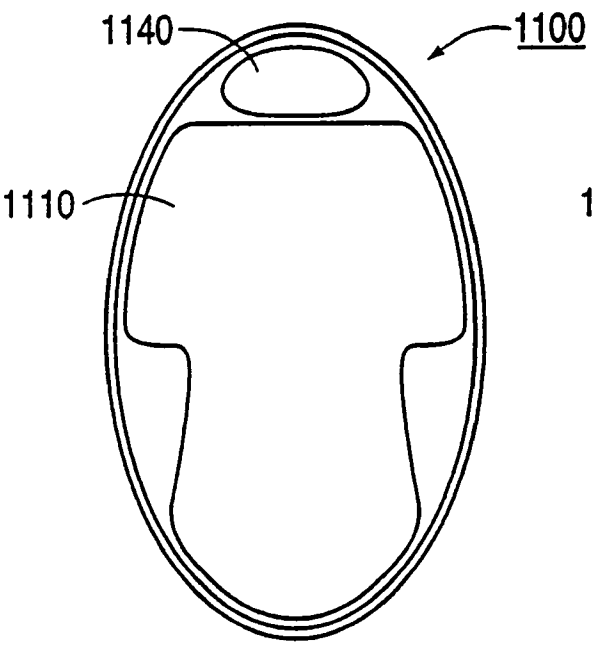
FIG. 25 illustrates a top view of a mat according to yet another embodiment of the present invention.

FIGS. 25 through 27 each illustrate a top view of a mat according to yet another embodiment of the present invention. FIG. 25 shows a mat 1100 having a body membrane 1110 and a raised support structure 1140. FIG. 26 shows a mat 1200 having a body membrane 1210 and a raised support structure 1240. FIG. 27 shows a mat 1300 having a body membrane 1310 and a raised support structure 1340. The body membranes 1110, 1210 and 1310, and raised support structures 1140, 1240 and 1340 are examples of alternative shapes. The body membranes 1010, 1110, 1210 and 1310 can be made according to the method described above in reference to FIGS. 13 and 14. In other words, the shapes of body membranes 1010, 1110, 1210 and 1310 allow these body membranes to be cut from a sheet of material so that adjacent body membranes are, for example, nested.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

The above description of the embodiments is provided to enable any person skilled in the art to make or use the present invention. While the invention has been particularly shown and described with reference to embodiments thereof, it will be understood by those skilled in the art that various changes in form and details may be made therein without departing from the spirit and scope of the invention. For example, the mat can have a square or rectangular shape with rounded corners.

What is claimed is:

1. An apparatus, comprising:

a frame configured to form a closed loop, the frame being moveable between a coiled configuration and an uncoiled configuration;

a sleeve configured to receive the frame, the sleeve defining an opening within at least a portion of the closed loop;

a membrane coupled to the sleeve, the membrane defining a substantially planar surface within the closed loop and extending across the opening defined by the sleeve from a first location proximate a perimeter of the opening to a second location proximate the perimeter of the opening on an opposite side of the opening; and a plurality of attachment mechanisms coupled to at least one of the sleeve or the membrane and configured to removably couple a body membrane to at least one of the sleeve or the membrane, each attachment mechanism from the plurality of attachment mechanisms having a first end and a second end, the first end of each attachment mechanism from the plurality of attachment mechanisms coupled to at least one of the sleeve or the membrane at a first location associated with that attachment mechanism and proximate the perimeter of the opening defined by the sleeve, the second end of each attachment mechanism from the plurality of attachment mechanisms coupled to at least one of the sleeve or the membrane at a second location associated with that attachment mechanism and proximate the perimeter of the opening defined by the sleeve such that each attachment mechanism from the plurality of attachment mechanisms extends across the opening defined by the sleeve.

2. The apparatus of claim 1, wherein the plurality of attachment mechanisms are each constructed with elastic material.

3. The apparatus of claim 1, further comprising:

at least a portion of a mating fastener coupled to the sleeve configured to removably couple the membrane to the sleeve.

4. An apparatus, comprising:

a frame configured to form a closed loop, the frame being moveable between a coiled configuration and an uncoiled configuration; and a membrane coupled to the frame, the membrane defining a substantially planar surface within the closed loop and including an attachment mechanism, the attachment mechanism having a first end and a second end, the first end of the attachment mechanism coupled to the membrane at a first location proximate a perimeter of the membrane, the second end of the attachment mechanism coupled to a second location proximate the perimeter of the membrane such that the attachment mechanism extends across a portion of the substantially planar surface defined by the membrane.

5. The apparatus of claim 4, wherein the attachment mechanism is configured to removably couple a body membrane to the membrane.

6. The apparatus of claim 4, wherein the attachment mechanism is constructed with elastic material.

7. The apparatus of claim 4, further comprising:

a sleeve, the frame disposed within the sleeve.

8. The apparatus of claim 4, further comprising:

a sleeve, the frame disposed within the sleeve, the membrane coupled to the sleeve.

9. The apparatus of claim 4, further comprising:

a fabric member coupled to the frame; and at least a portion of a mating fastener coupled about at least a portion of the perimeter of the membrane configured to couple the membrane to the fabric member.

10. An apparatus, comprising:

a membrane configured to be coupled to a collapsible frame, the membrane defining a substantially planar surface within a closed loop defined by the collapsible frame when the membrane is coupled to the collapsible frame, the membrane including a cup holder; and a mating fastener coupled about at least a portion of a perimeter of the membrane, the mating fastener configured to removably couple the membrane to the collapsible frame.

11. The apparatus of claim 10, wherein the collapsible frame has a coiled configuration and an uncoiled configuration, the cup holder configured to extend below the membrane when the membrane is coupled to the frame and the frame is in the uncoiled configuration.

12. The apparatus of claim 10, further comprising:

a plurality of attachment mechanisms coupled to the membrane, the plurality of attachment mechanisms configured to removably couple a body membrane to the membrane.

13. The apparatus of claim 10, wherein the mating fastener is configured to removably couple the membrane to an interior membrane coupled to the frame.

* * * * *